US006601931B1

(12) United States Patent
Schairbaum et al.

(10) Patent No.: US 6,601,931 B1
(45) Date of Patent: Aug. 5, 2003

(54) COMBINED WORK STATION APERTURE FRAME AND FLAT MONITOR SUPPORT

(75) Inventors: Edward C. Schairbaum, Fort Worth, TX (US); John N. Lechman, Effingham, IL (US)

(73) Assignee: Nova Solutions, Inc., Effingham, IL (US)

( * ) Notice: Subject to any disclaimer, the term of this patent is extended or adjusted under 35 U.S.C. 154(b) by 21 days.

(21) Appl. No.: 09/723,937

(22) Filed: Nov. 28, 2000

(51) Int. Cl.[7] ..... A47B 17/06
(52) U.S. Cl. ..... 312/194; 108/26
(58) Field of Search ..... 312/194, 195, 312/196, 223.3, 223.6, 21, 24, 26, 30; 108/50.01, 50.02, 26; 248/918, 919, 922, 923

(56) References Cited

U.S. PATENT DOCUMENTS

| | | | | |
|---|---|---|---|---|
| 5,125,727 A | | 6/1992 | Lechman et al. | |
| RE34,266 E | | 6/1993 | Schairbaum | |
| 5,290,099 A | | 3/1994 | Lechman | |
| 5,651,594 A | | 7/1997 | Lechman | |
| 5,655,822 A | * | 8/1997 | Roberts et al. | 312/194 |
| 5,655,823 A | * | 8/1997 | Schairbaum | 312/194 |
| 5,699,744 A | | 12/1997 | Lechman | |
| 5,964,164 A | | 10/1999 | Lechman | |
| 6,019,051 A | | 2/2000 | Schairbaum | |
| 6,152,046 A | | 11/2000 | Schairbaum et al. | |

FOREIGN PATENT DOCUMENTS

| | | | | |
|---|---|---|---|---|
| WO | WO 92/06616 | * | 4/1992 | 312/194 |

* cited by examiner

*Primary Examiner*—James O. Hansen
(74) *Attorney, Agent, or Firm*—Webb & Lewis LLC; Glenn Webb

(57) ABSTRACT

An assembly is provided or supporting a flat monitor in adjacent but underlying relationship to a preferably window pane equipped, preferably rectangularly-configured aperture provided in a desk-type working platform. An aperture frame extends about perimeter portions of the aperture. A flat monitor support platform is located beneath but adjacent to the aperture. Joining components extend between and interconnect portions of the aperture frame with portions of the flat monitor support platform. A flat monitor is supportable by the platform with the platform generally suspended from the aperture frame with the aperture frame so positioned in the aperture. The flat monitor viewing screen with the flat monitor so supported is viewable through the aperture. The inclination of the flat monitor viewing screen is adjustable if desired. Various aperture frame structures, flat monitor support platforms, and joining components can be utilized.

36 Claims, 7 Drawing Sheets

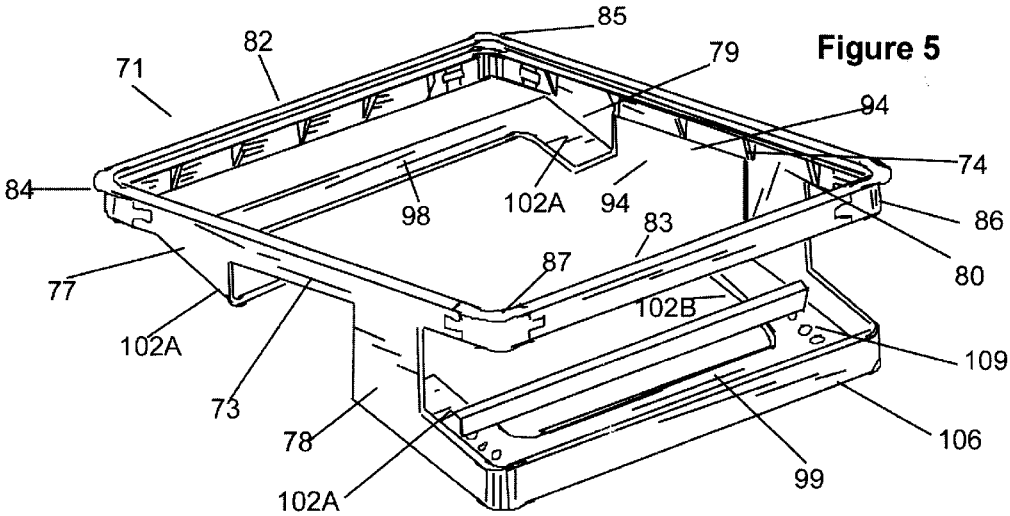
Figure 5
Figure 7
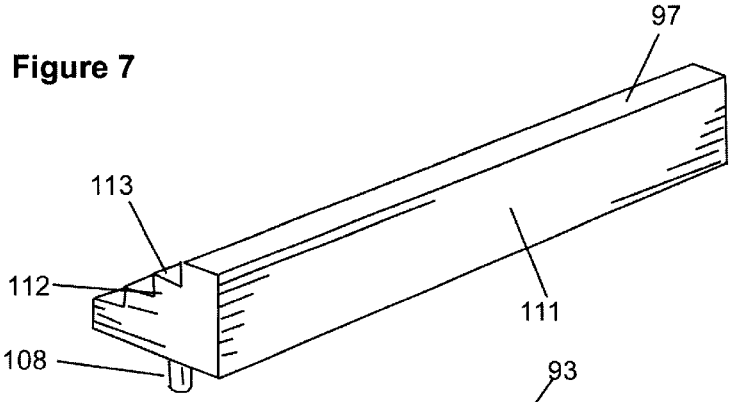
Figure 6
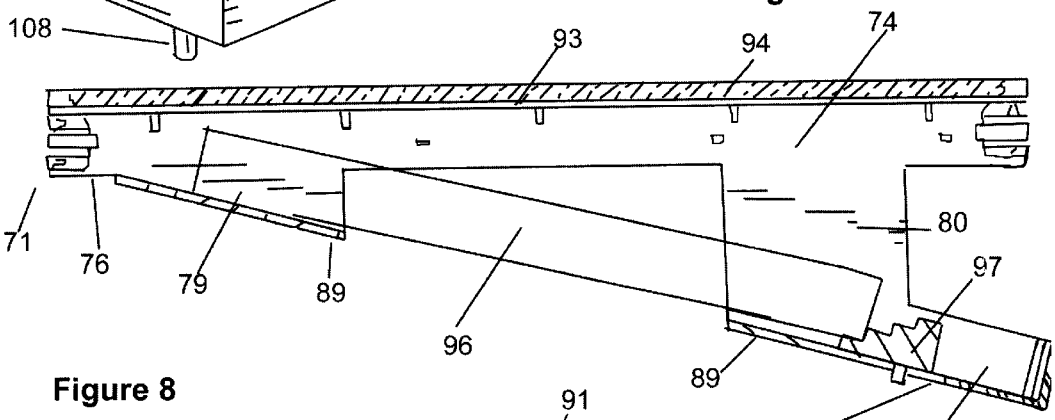
Figure 8
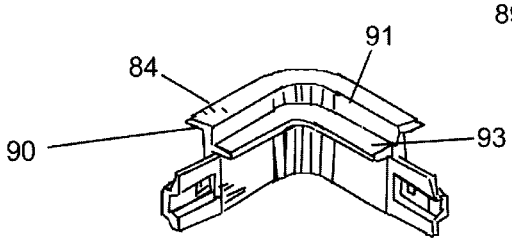

COMBINED WORK STATION APERTURE FRAME AND FLAT MONITOR SUPPORT

FIELD OF THE INVENTION

This invention relates to work stations having a flat monitor under an apertured working platform and, more particularly, combination assemblies for association with a perimeter portion of an aperture in a working platform of a work station so that a flat monitor is supportable below but adjacent to the platform aperture and is viewable through the aperture by a worker who is usually seated adjacent to the working platform for working thereon.

BACKGROUND OF THE INVENTION

Monitors can be supported under a work station working platform for station user viewability through an aperture provided in the platform. Usually, the aperture is provided with a generally transparent window. A pioneering arrangement of this type is found in Schairbaum U.S. Pat. No. Re. 34,266, although various improvements and adaptations are now known; see, for example, the teachings of Lechman et al U.S. Pat. No. 5,125,727, Lechman U.S. Des. Pat. No. 327,791 and Lechman U.S. Pat. No. 5,290,099, which involve so-called conventional monitors, and also the teachings of Lechman U.S. Pat. No. 5,699,744, Lechman U.S. Pat. No. 5,964,164 and Lechman U.S. Pat. No. 5,651,594, which involve so-called flat monitors.

Briefly, so-called conventional monitors have an exterior configuration that characteristically somewhat resembles a bulky cube or, sometimes, an irregularly shaped or multi-sided structure. Such monitors have a viewing screen located in a side or end face thereof. In operation, a conventional monitor internally generates externally electronically controlled electron beam(s) that sweep systematically across a phosphor-coated screen interior surface to generate externally viewable images on the screen.

So-called flat monitors have an exterior configuration that characteristically resembles a relatively thin, flattened box with a rectangular or even square configuration and generally opposed sides. Such monitors have a viewing screen located in a side face thereof. In operation, a flat monitor internally generates externally electronically controlled signals that locally excite predetermined portions of a phosphor-coated screen interior surface to generate externally viewable images on the screen.

Because of the differences between conventional monitors and flat monitors, especially with regard to shape, and weight, but also with regard to, for example, case size, heat generation, power supply requirements and control signals, there is a need in the field of work stations having a flat monitor under the working platform to utilize different support structures compared to those used for conventional monitors.

For many work station environments where flat monitors are to be used, it has previously been desirable to associate a flat monitor support with portions of the work station at locations beneath but adjacent to the viewing aperture in the station working platform. To achieve this association, it has been necessary to mount a flat monitor support beneath the working platform using a mounting system having multiple parts, such as special brackets, screws, rivets, and the like. The installation tends to be tedious, awkward, labor intensive and time consuming, and the cost can be significant. The mounting of a window over the aperture is a separate, independent, time-consuming operation.

However, problems associated with the formation of an aperture in a work station working platform have been reduced or overcome by the provision of improved methods and apparatus, such as taught in Schairbaum U.S. Pat. No. 6,085,431, and problems associated with the mounting of a window at an aperture have been reduced or overcome by the provision of an aperture liner sleeve or frame, such as taught in Schairbaum U.S. Pat. No. 6,019,051 or in allowed but not yet issued Schairbaum U.S. patent application Ser. No. 09/232,124 filed Jan. 15, 1999.

Yet, there remains a need in the field of work stations having a flat monitor positioned under an aperture in the working platform for improvements in systems for mounting and positioning of the flat monitor beneath the working platform aperture.

So far as now known, no one has previously provided in a work station an assembly combination which enables one to support a flat monitor beneath but adjacent to the working platform aperture using a flat monitor support that is itself held by a frame that extends about the aperture perimeter, the aperture also preferably being windowed.

SUMMARY OF THE INVENTION

This invention is directed to a combination assembly for association with an aperture defined in the working platform of a work station structure. The combination assembly comprises an aperture frame for extending about aperture perimeter portions, a flat monitor support platform that is generally adjacent to the aperture frame, and joining components extending between and interconnecting portions of the aperture frame with portions of the flat monitor support platform. Preferably, the aperture frame can also associate with a generally transparent window that covers the aperture. When the combination assembly is associated with an aperture, the flat monitor support platform is generally suspended from the aperture frame, and a flat monitor is supportable by the flat monitor support platform with the monitor viewing screen being viewable through the aperture.

The invention is also directed to work stations that incorporate the inventive combination assembly.

The aperture frame of the combination assembly associates with perimeter portions of a preformed aperture defined through a working platform of a work station. Preferably, the frame as so associated is adapted for the mounting of a generally transparent window generally in and across the aperture and the frame.

When the aperture frame is so associated with the aperture, and the working platform is in a generally horizontal orientation, the flat monitor support platform is generally in vertically spaced but adjacent relationship to the aperture frame and a flat monitor is supportable by the flat monitor support platform. The relationship between components is preferably such that the so supported flat monitor is generally beneath but adjacent to the aperture frame and the aperture. When a transparent window, as is preferred, is associated with the aperture and the aperture frame, with the frame associated with the aperture perimeter, the window is above a flat monitor that is supported by the flat monitor support platform, and the window is in non-interfering relationship relative to the flat monitor support platform, the joining components, and the so supported flat monitor.

The aperture frame can unitarily formed of, for example, molded plastic or the like, or the frame can have its opposing sides and corner portions separately and preferably unitarily formed but preferably end connectable with each other.

Thus, when separately formed, the side and corner components preferably have respective opposite end portions that are adapted to engage with the respective opposite end portions of the adjacent components when the aperture frame is assembled, positioned in an aperture, and associated with a working platform. Sometimes, or if desired, conventional auxiliary fastening means may be employed to associate an aperture frame with portions of a working platform that are adjacent to, and that define, perimeter portions of an aperture. Usually an aperture frame is adapted for locating about the perimeter of an aperture that has a rectangular or square configuration and that is formed in a working platform that has a generally flat working surface.

The joining components extend between portions of the aperture frame and preferably adjacent portions of the flat monitor support platform. Preferably, the joining components have upper end portions that are unitarily formed with adjacent lower edge portions of the aperture frame. The lower end portions of the joining components may be unitarily formed with adjacent edge portions of the flat monitor support platform. When the joining components are not unitarily formed with adjacent portions of the aperture frame or the flat monitor support platform, they may be connectable thereto by mechanical, disconnectable, and/or adjustable interconnecting means, including auxiliary fastening means, or otherwise, as may be desired. The joining components either can be comprised of the same construction material as the aperture frame or the flat monitor support platform, as when the joining components are unitarily formed with portions of the aperture frame and/or the flat monitor support platform, or can be comprised of a different construction material, as those skilled in the art will readily appreciate.

The flat monitor support platform can be a unitarily formed structure or it can be comprised of component portions that are separated and separately formed and connected with joining components. The flat monitor support platform can incorporate a continuously or uninterrupted support surface for a flat monitor, or can incorporate a discontinuous or interrupted support surface. The flat monitor support platform can be unitarily formed with adjacent portions of joining components or can otherwise be connected thereto, as desired. The flat monitor support platform can have a wide variety of shapes, sizes, structures, and the like, as those skilled in the art will readily appreciate.

The combination assembly avoids or minimizes prior art problems, such as above indicated, that are associated with the mounting or the support of a flat monitor beneath an aperture in a work station working platform. An aperture is preferably associated with a window. While a window may be installed after a combination assembly is associated with an aperture, a window may sometimes be associated with an aperture frame before a combination assembly is installed in a working platform aperture.

Conveniently and preferably, a combination support assembly embodiment may be substantially preassembled before being associated with an aperture in a working platform.

The inventive combination assembly can have many forms and embodiments, yet is generally convenient, simple, economical to manufacture, reliable, safe and easy to install and use, and labor-saving.

Preferably, a flat monitor may be easily positioned on, position or orientation adjusted, or removed from, a flat monitor support platform of a combination assembly, sometimes, if desired, before a window is associated with an aperture frame.

In one presently preferred form, an embodiment of a combination assembly has the aperture frame, the flat monitor support platform, and the joining components, or some combination thereof, unitarily formed. In general, unitarily formed components are preferably produced by molding a plastic (presently preferred) or a metal into a desired component or combination of components. Combinations of plastic and metal components can be used, if desired, including metal coated plastic or plastic coated metal. Filled and reinforced plastics can be used. Suitable plastics and metals adapted for fabricating components or the combination assembly are well known to those skilled in the art. A combination assembly of the invention can be comprised of separately formed components that are connected together in either subassemblies or in a complete assembly before the combination assembly is associated with an aperture in a working platform.

Preferably, in an installation in the aperture of a working platform, the screen of a flat monitor as supported by the flat monitor support platform of a combination assembly is inclinable relative to the aperture frame, thereby to facilitate viewability of the flat monitor screen through the preferably windowed aperture by a seated user located along one side of the working platform at a work station.

In another presently preferred form, an embodiment of a combination assembly is characterized by having an adjustable angle of inclination for a supported flat monitor relative to the aperture frame. Various flat monitor position and tilt angle adjustment means can be used. Conveniently, and for example, the flat monitor inclination angle is regulated by incorporating into the joining components platform adjusting elements. For example, the joining components along one side of a flat monitor support platform may incorporate hinge means for pivoting the support platform relative to an interconnect aperture frame, while joining components that are located along at least one adjacent side, or along an opposite side of the flat monitor support platform, may incorporate joining component effective length adjusting means for adjustably fixing the inclination of a support platform relative to an interconnected aperture frame.

Conveniently, and for another example, the flat monitor inclination angle is regulated by associating with the flat monitor support platform components that are adjustably positionable relative to the support platform, or that are adjustably changeable in effective height, as taught herein, so that the inclination angle of a flat monitor on the support platform is adjustable even through the support platform itself may be fixed in orientation relative to the aperture frame. Conveniently, a flat monitor's spatial position or orientation relative to a support platform is regulated by adjustably positionable retaining means, such as a cross bar, or the like, that is associated with a flat monitor support.

Preferably, a flat monitor's spatial position on, or in association with, the flat monitor support platform in an installed combination assembly, is adjustable, especially relative to an overlying window, either in a transverse (or top to bottom) direction or in a cross (left to right, vice versa) direction.

If desired, a combination assembly can incorporate more than one means for adjusting the inclination angle or orientation of a flat monitor relative to an aperture frame.

Preferably a combination assembly is adapted for use with a working platform that has an aperture of preselected size formed therein. However, if desired, an embodiment of a combination assembly of the invention can be adapted for usage with apertures that vary in size from one platform to another, or for usage with various flat monitor sizes and configurations.

If desired, a combination assembly of the invention can be adapted and used after installation after installation at a work station for support of a lap-top computer or the like that incorporates an interconnected flat monitor where the flat monitor remains associated with the lap-top computer or the like during usage at the work station. If desired, the work station is equipped with an auxiliary keyboard and/or an auxiliary conventional monitor either or both of which is/are functionally associatable with the laptop computer during usage at the work station.

An embodiment of the inventive combination assembly can incorporate either no or minimal disassociatable components, thereby to eliminate the risk of loss or separation of any disassociatable components.

Preferably, usage of an embodiment of a combination assembly results in little or even no interference with the existing or usual wire and cable interconnection components associated with a particular flat monitor as the flat monitor is supported by the flat monitor support platform.

Preferably, an embodiment of a combination support assembly as installed in a working platform of a work station results in little or no interference with a horizontally slidable keyboard support tray, or drawer, or the like, that may be associated with such work station. Such a slidable tray may be located in such work station when in a tray closed position so as to be generally beneath, or adjacent to, the work station's working platform and so as to be generally between the forward edge of the working platform that is adjacent to a seated user and the side of the aperture nearest thereto.

Various other features, aspects, embodiments, objects, aims, purposes, applications, and the like for the present invention will be apparent to those skilled in the art from the present description taken with the accompanying drawings.

BRIEF DESCRIPTION OF THE DRAWINGS

In the drawings:

FIG. 5 is a perspective view similar to FIG. 2, but showing another alternative embodiment of the inventive combination assembly with the window shown fragmentarily, this combination assembly incorporating a multi-component aperture frame;

FIG. 6 is transverse vertical sectional view taken medially through the combination support assembly of FIG. 5 with the flat monitor support platform supporting a flat monitor (the flat monitor being shown in phantom);

FIG. 7 is a perspective view of the flat monitor position adjustment cross-bar employed in the embodiment of FIGS. 5 and 6 for flat monitor position and elevation adjustment;

FIG. 8 is an enlarged perspective view of one of the four substantially identical aperture frame corner components employed in the aperture frame of the combination assembly of FIGS. 5 and 6;

DETAILED DESCRIPTION

Figure 1:
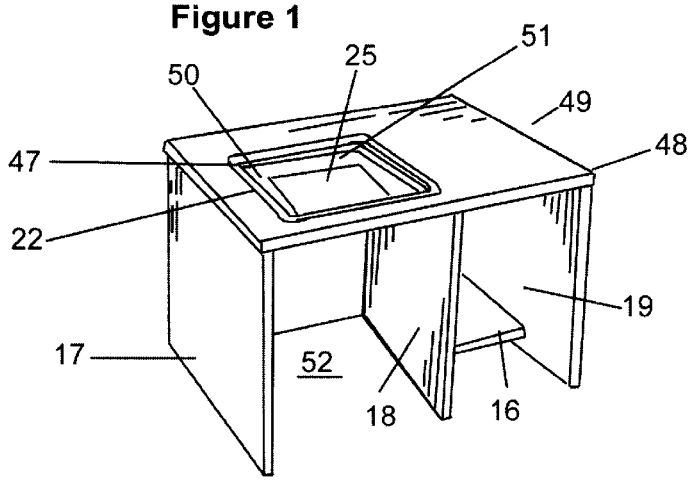
FIG. 1 is a perspective, environmental view illustrating a work station equipped with an embodiment of the inventive combination assembly.

Referring to FIGS. 1–4, there is seen an embodiment 21 of the combination assembly of the present invention. In use, the combination assembly 21 is functionally associated with a work station, such as illustrative work station 49, that preferably has a thickened working platform 48. The working platform 48 is conveniently supported in a generally horizontal orientation by panels 17, 18 and 19, or otherwise, as may be desired. Between panels 17 and 18, a kneehole 52 is provided, and between panels 18 and 19, a shelf 16 is provided for holding computer or computer components, or otherwise, is provided. The platform 48 is provided with an aperture 50 that is conveniently located over the kneehole 52. Various work station structures can be used, as will be readily apparent to those skilled in the art. A flat monitor 25 is supported beneath the aperture 50.

The combination assembly 21 is associated with the aperture 50 of the working platform 48, as further explained below. The combination assembly 21 incorporates an aperture frame 22, a flat monitor support platform 23, and, as joining components for the aperture frame 22 and the flat monitor platform 23, both a hinge 24 that interconnects the back side 28 of the flat monitor support platform 23 with the rear side 29 of the aperture frame 22 and also a pair of length-adjustable joining arms 26 and 27.

The combination assembly 21, including the aperture frame 22, the flat monitor support platform 23, the hinge 24 and the joining arms 26 and 27, is, as shown, preferably unitarily comprised of a molded plastic that is conveniently formed in a conventional molding operation. Various plastics can be employed, for example, a high density polypropylene, an ABS resin, a nylon, or the like. An assembly 21 may be formed of a metal, if desired. A present preference is to provide the combination assembly 21 with a dark coloration and with surface portions that are generally non-reflective and glare-resistant relative to incident light. Those skilled in the art will appreciate that various configurations and structures can be employed in a combination assembly 21 to comprise the aperture frame 22, the flat monitor support platform 23, and the joining components.

Conveniently and preferably, the hinge 24 is of the so called, well-known " living hinge" type that has leave portions that are integral with adjacent portions of the aperture frame 22 and the flat monitor support platform 23.

Conveniently and preferably, the upper end of each of the joining arms 26 and 27 is unitarily joined to a lower edge portion mid-region of a different opposite side 44 and 46, respectively, of the aperture frame 22. Each arm 26 and 27 downwardly extends so as to extend along and across a different portion of a respective opposite side 37 and 39 of the flat monitor support platform 23. The arms 26 and 27 are preferably symmetrically arranged relative to combination assembly 21 and the arms 26 and 27 are preferably in spaced, parallel relationship to each other. The joining arms 26 and 27 are each here configured as a flattened, elongated strip that has an elongated channel or slot 33 and 34, respectively, defined therein.

Those skilled in the art will appreciate that various alternative arm structures and arm arrangements can be used, if desired. For example, a single joining arm (not shown) can extend from unitary relationship with a mid-region of the lower edge region of the front side 46 of aperture frame 22 and extend along and across a portion of the front side 38 of the flat monitor support platform 22.

When the aperture frame 50 of the combination assembly 21 is associated with an aperture 50, the aperture frame 22, the size interrelationship is chosen so that the aperture frame 22 extends about the perimeter of the aperture 50. Optionally, but conveniently and preferably, the upper perimeter edge portions of the aperture frame 22 are provided with an out-turned shoulder flange 47 that is conveniently and preferably unitarily formed with, and extends generally perpendicularly relative to, the aperture frame 22, and that is configured to extend over, and associate in a flush overlapping relationship with, the aperture 50 perimeter-adjacent portions of the top or working surface of working platform 48 that are next to the aperture 50. The shoulder flange 47 continuously extends around the upper perimeter edge portions of the aperture 22 and is adapted to rest upon adjacent upper surface edge portions of the working platform 48 which are next to the aperture 50.

Auxiliary conventional fastening means (not shown), such as an adhesive, metal fasteners, or the like, may be used to fix wall portions of the aperture frame 22 to the perimeter portions of aperture 50-that are defined by adjacent portions of the working platform 50, as those skilled in the art will appreciate.

Figure 4A:
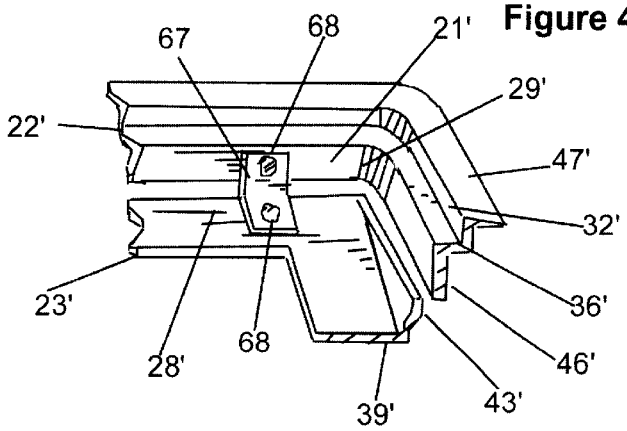
FIG. 4A is a fragmentary view similar to a portion of FIG. 4 but showing the back right side region of an alternative embodiment of the combination assembly of FIGS. 1 and 2 wherein the aperture frame is separately formed from the flat monitor support platform and where the aperture frame is joined to the flat monitor support platform by a plurality of angled brackets (one bracket being illustratively shown in FIG. 4A)
Figure 3:
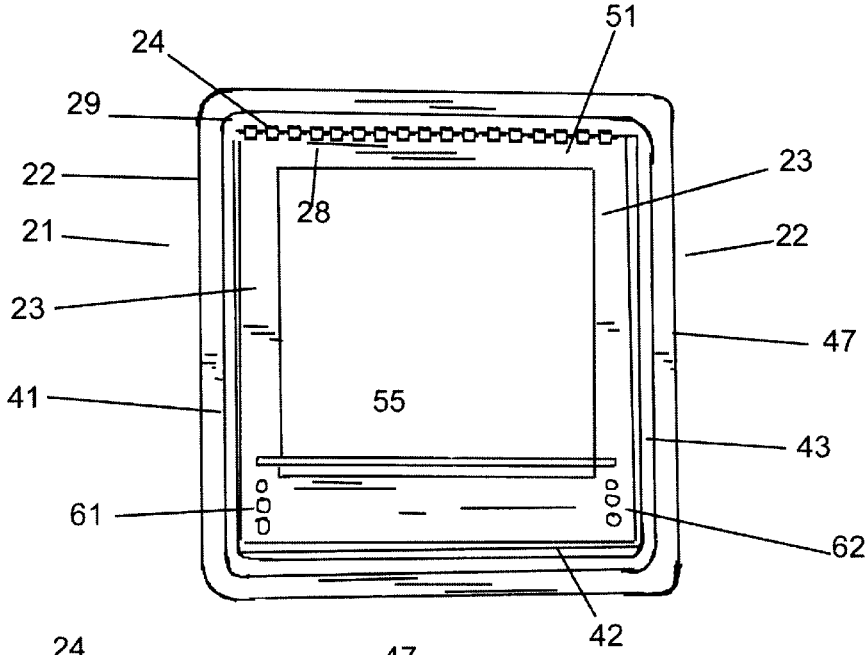
FIG. 3 is a plan view of the combination assembly of FIGS. 1 and 2 shown apart from the work station and with the aperture window shown fragmentarily.
Figure 4:
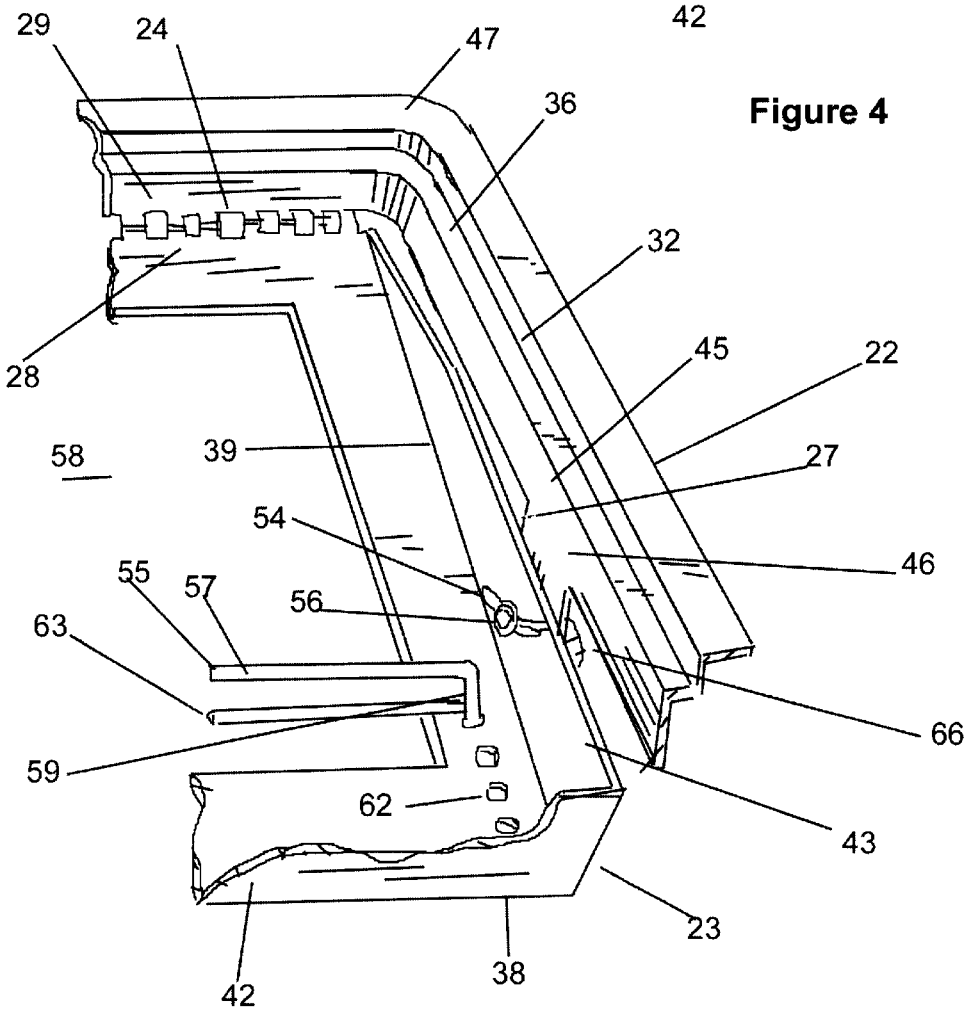
FIG. 4 is an enlarged, fragmentary, perspective, detailed view of the right side portion of the combination assembly of FIGS. 1 and 2.
Figure 9:
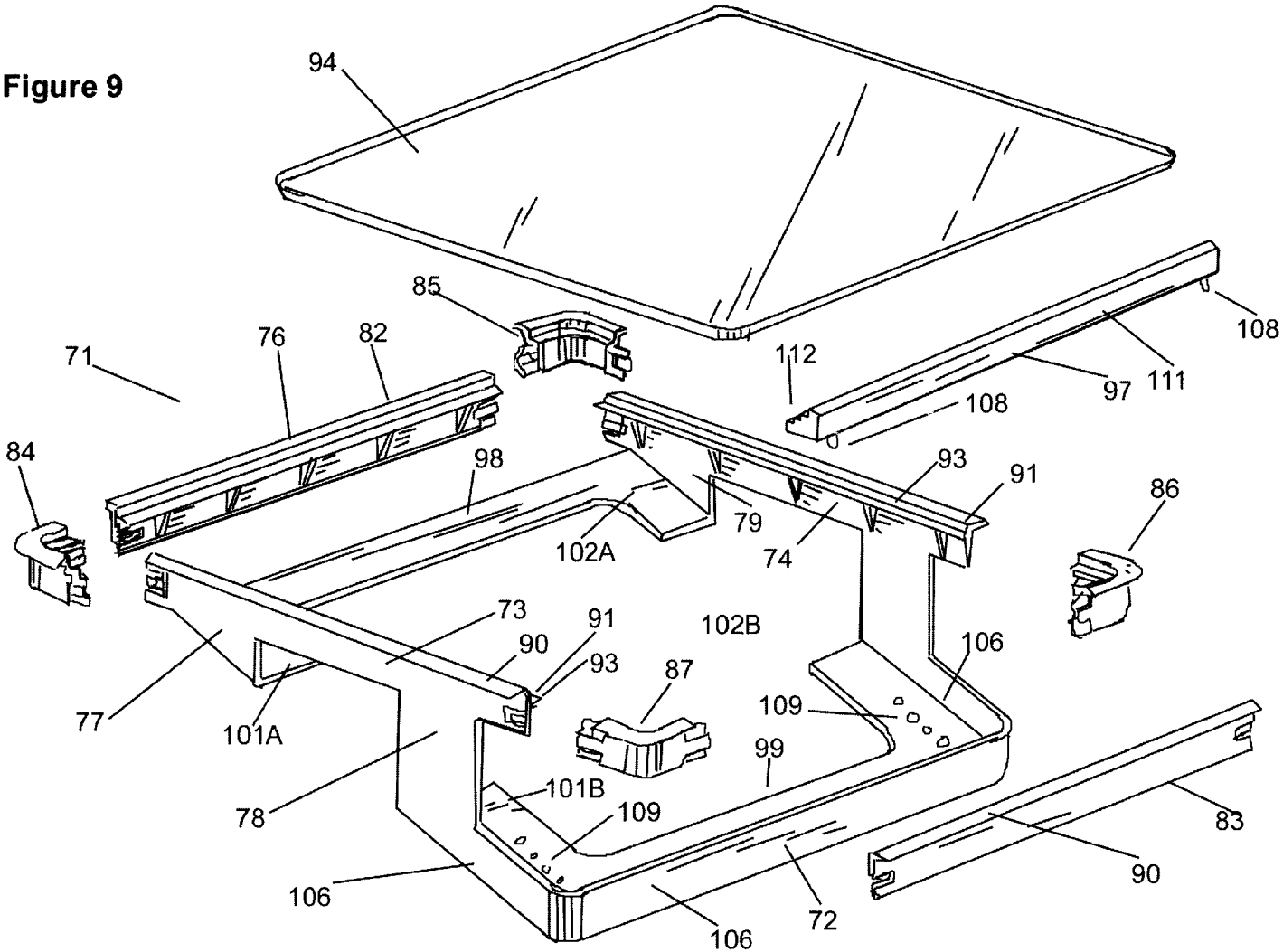
FIG. 9 is an exploded perspective view of the combination support assembly of FIGS. 5 and 6.

As shown, for example, in FIGS. 3 and 4, upper inside (relative to aperture 50) surface portions 32 of the aperture frame 22 that continuously extend around the aperture frame 22 are preferably configured to receive slidably thereover in adjacent relationship edge portions of a preferably substantially transparent window 51 comprised of glass (preferably) or plastic. The aperture frame 22 is also preferably, and as shown for example, in FIG. 4, provided with an out-turned ledge 36 that is located just below the upper inside surface portions 32 and that continuously extends around the frame 22. When the window 51 is positioned in and across the aperture 50 adjacent the aperture frame 22, the perimeter edge-adjacent portions of the window 51 can rest on ledge 36 and be supported thereby. The relationship between the aperture frame 22, the perimeter portions of the aperture 50, and the window 51 is preferably such that, when the window 51 is received in and across the aperture 50 with window edge portions adjacent to the aperture frame 22, the window 51 and the aperture frame 22 are retained in the aperture 50. The perimeter of the working platform 48 defining portions of the aperture 50 can be configured to conform to the outside surface configuration of the aperture frame 50, as shown, for example, in FIG. 4.

Those skilled in the art will readily appreciate that the aperture frame 22 can have various configurations and arrangements.

The relationship between the joining components, here comprising the hinge 24 and the arms 26 and 27, the aperture frame 22, and the flat monitor support platform 23 is such that the flat monitor 25 is supportable by the flat monitor support platform 23 when the aperture frame 22 and the window 51, if used, are so retained in the aperture 50. When the aperture frame 22 is so associated with the aperture 50, and the working platform 48 is in a generally horizontal orientation, the flat monitor support platform 23 is generally in vertically spaced but adjacent relationship to the aperture frame 22 and a flat monitor, such as monitor 25, is supportable by the flat monitor support platform 23. The relationship between components is preferably such that the so-supported flat monitor 25 is generally beneath but adjacent to the aperture frame 22 and the aperture 50. Preferably, when a transparent window 51, is associated with the aperture 50 and the aperture frame 22 with the frame 22 associated with the aperture 50 perimeter, the window 51 is above the flat monitor 25 that is supported by the flat monitor support platform 23, and the window 51 is in non-interfering relationship relative to the flat monitor support platform 23, the joining components, and the so supported flat monitor 25.

Conveniently and preferably, the hinge 24 includes a generally linearly extending pivotal portion 24A that is located between, and in parallel relationship to, respective portions of the back side 28 and the rear side 29. The flat monitor support platform 23 pivots relative to the aperture frame 22 about the pivotal portion 24A. The pivotal portion 24A is here periodically and regularly interrupted along its length by a series of small gaps or spacings 31. Depending upon the construction material employed, and upon construction variables, the spacings 31 in the pivotal portions 24A may aid in defining and maintaining the linear extent and flexibility of the pivotal portion 24A without significant loss of hinge 24 load-bearing strength, as desired to enable the back side 28 of the flat monitor support platform 23 to be supported by, and to be pivotable relative to, adjacent portions of the aperture frame 22 when the platform 23 is holding the flat monitor 25. However, if desired, the spacings 31 can be eliminated so that the pivotal portions 24A extend continuously over the length thereof.

Various arrangements and configurations may be employed regarding a hinge structure that interconnects aperture frame 22 and flat monitor support platform 23, as those skilled in the art will readily appreciate.

In the flat monitor support platform 23 of the combination assembly 21, the opposite sides 37 and 39, and the front side 38, of the platform 23 are each provided with a preferably vertically upstanding (relative to base portions of platform 23) peripheral railing 41, 43 and 42, respectively. This railing is preferably and as shown unitarily formed with the platform 23 and continuously so extends about the platform sides 37, 38 and 39.

Those skilled in the art will readily appreciate that various configurations and structural components can be used to provide a flat monitor support assembly in the inventive combination assembly.

Figure 2:
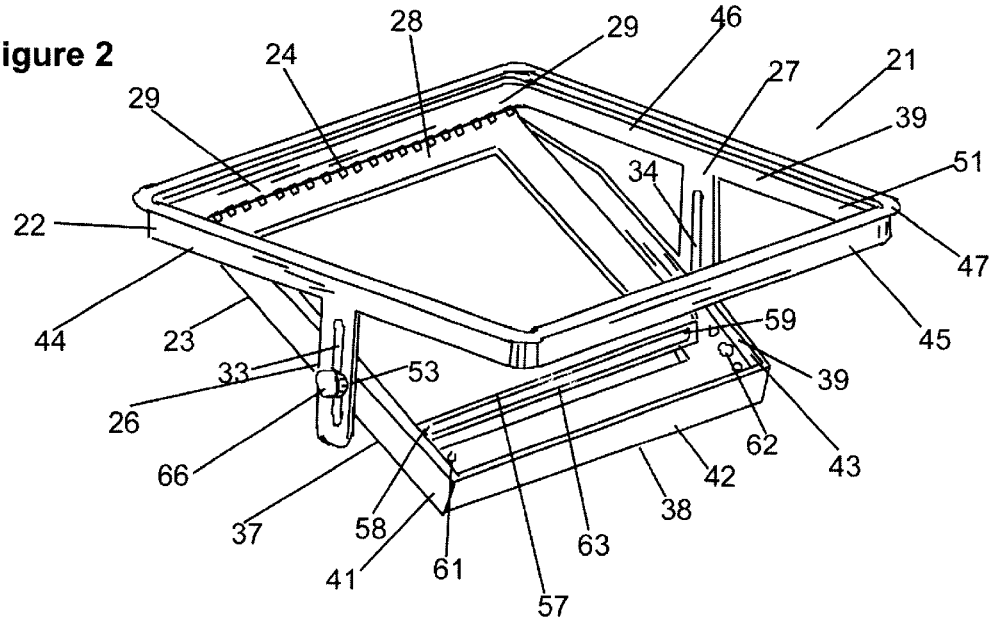
FIG. 2 is a perspective view of the combination assembly of FIG. 1 shown apart from the work station and with the associated aperture window shown fragmentarily, the combination assembly being unitarily formed.

In the combination assembly 21, the width between the outside of the side railings 41 and 43, and the support assembly 21 length between the outside of the front railing 42 and the hinge 24-adjacent the back side 28, are each preferably such that the support platform 23 may be nestably received within the aperture frame 22 relative to the respective opposite sides 44 and 46, and to the forward side 45, as when the assembly 21 is not being used to support a flat monitor 25. To avoid potential interference problems, the rear end portions of the railings 41 and 43 may be conveniently beveled, as shown in FIGS. 2 and 4, for example. Thus, in the event that flat monitor 25 is not being supported upon the flat monitor support platform 23, the flat monitor support platform 23 can be pivoted upwards about the hinge 24 and stored generally within and adjacent to the aperture frame 22 with minimal interference of viewability through the window 51. Such a frame 22 and platform 23 nesting interrelationship can be useful if and when a conventional monitor (not shown) is to be independently supported and utilized temporarily beneath the window 51 of work station 49. An appropriate prior art conventional monitor support assembly is then employed to support the conventional monitor instead of the combination assembly 21.

In the side portion of each railing 41 and 43 over which each arm 26 and 27, respectively, moves as the flat monitor support 23 pivots about hinge 24 relative to the aperture frame 22, a curved slotted aperture or slot 53 and 54 is defined (see FIGS. 2 and 4) that is alignable with slots 33 and 34, respectively. A short, flat-headed carriage bolt 56 (see FIG. 4) is extended through each pair of slots 33, 53 and 34, 54 at overlying slot locations, and each bolt 56 is threadably associated with a blind nut 66 (see FIG. 2). Thus, a desired inclination or tilt angle of the flat monitor support platform 23 relative to the aperture frame 22 about hinge 24 over the length of the associated slots 53 and 54, and the slots 33 and 34, can be fixed, regulated and set by manually adjusting the applied compression provided by the two assemblies of bolts 56 and nuts 66.

An inclination angle of about 30 degrees to about 40 degrees, more preferably about 35 degrees, relative to horizontal (the plane of the aperture frame 22 and the working platform 48) is presently preferred in the various embodiments of this invention.

In the flat monitor support platform 23, the opposite sides 37 and 39, taken with the back side 28 and the front side 38, define therebetween a generally flat platform or stage region 58. In the platform 23, central portion of region 58 is open and region 58 is defined by flat platform-defining members that extend inwardly from the back side 28, the front side 38, and each of the opposite sides 37 and 39 and are continuously unitarily joined together. Those skilled in the art will appreciate that various alternative arrangements for providing a platform region 58 can be utilized.

Although gravity-augmented side and end sliding-type movements of a flat monitor 25 that is resting upon such platform region 59 are restrained and limited by the side railings 41 and 43 and the front railing 42, movement of the flat monitor 25 towards the front railing 42 may result in a positioning of the flat monitor 25 that is so near to the front edge of the window 51 adjacent to which a user sits that a lower portion of the viewing screen of the flat monitor 25 is not easily viewed by the user. To avoid this potentially undesirable result, the flat monitor support platform 23 is preferably provided with an adjustable fence or cross-bar structure 55 which can retain and space the forwardmost or front side portion of a flat monitor 25 away from the front railing 42 to a chosen extent. Then, portions of the screen of the flat monitor 25 near to the front of the window 51 can be viewed by a user seated along the adjacent front side of the working platform 48.

In the flat monitor support platform 23, the fence structure 55 is provided by a stiff straight wire 57 which extends nearly across the width of the flat monitor support 23 and which has down-turned opposite end portions 58 and 59. The terminus of end portion 58 is receivable through one of a series of aligned but transversely spaced holes 61 in the adjacent side portion 37 of platform 23, and, similarly, the terminus of end portion 59 is receivable through one of a series of aligned but transversely spaced holes 62 in the adjacent side portion 39 of platform 23. The wire 57 with end portions 58 and 59 each engaged with a respective hole 61 and 62, preferably selected to be in laterally opposed relationship to one another, acts like a fence which limits the extend of forward sliding movement of the flat monitor 25 towards the front railing 42 down the incline defined by the flat platform region 58 of flat monitor support platform 23. By selecting pairs of individual holes 61 and 62 into which the respective ends 58 and 59 are inserted, the transverse location of the wire 57 can be varied so that the position of the flat monitor screen as it rests mainly upon the platform of the monitor support 23 is regulatable relative to the viewing window 51. A stiffening cross wire 63 preferably extends in straight, adjacent, spaced, parallel relationship to wire 57 and is welded or the like at its opposite ends to adjacent regions of each of the end wire portions 58 and 59. The wire 63 may enhance the available useful area for abutting against portions of a flat monitor front edge and also limits the depth to which the end portions 58 and 59 may sink into the holes 61 and 62.

Those skilled in the art will readily appreciate that various fence structures can be utilized in combination with the flat monitor support platform 23.

Variations in the structure of the combination support assembly 21 will be apparent to those skilled in the art. For example, as illustrated in the alternative assembly embodiment 21' shown in FIG. 4A, wherein components corresponding to those in assembly 21 are similarly numbered but with prime marks associated therewith for identification purposes, the flat monitor support platform 23' is formed separately from the aperture frame 22'. The hinge 24 is eliminated and replaced by a plurality of spaced, angled brackets 67 that are fastened by screws 68 or the like to each of the lower rear side 29' of the sleeve 22' and the back side 28' of the support 23', thereby joining the aperture frame 22' to the support platform 23'. The outside walls of the aperture frame 22 are provided with unitarily formed reinforcing buttresses that are also configured to rest against aperture 50-adjacent portions of the working platform 48.

Referring to FIGS. 5–9, there is seen another embodiment 71 of the combination assembly of the invention. As shown, for example, in the exploded perspective view of FIG. 9, in the combination assembly 71, the flat monitor support platform 72 is itself unitarily formed and is also unitarily formed in combination with respective lower end portions of each of the joining components 77, 78, 79 and 80 that extend upwardly from portions of the flat monitor support platform 72. In turn, the respective upper end portions of each of the joining components 77, 78, 79 and 80 is unitarily joined to components of the aperture frame 76.

The aperture frame 76 is comprised of multiple components. In the aperture frame 76, the opposite end components 82 and 83, and also the four corner components 84, 85, 86 and 87, respectively, are preferably identically configured, thereby permitting these two respective component types to be formed using the same or identical molds, as those skilled in the art will readily appreciate. The side component 73 of the multiple component aperture frame 76 incorporates the joining components 77 and 78, while the opposite side component 74 of the frame 76 incorporates the joining components 79 and 80.

The flat monitor support platform 72 and the joining components 77, 78, 79, and 80 are conveniently concurrently formed in a molding operation. The components of the aperture frame 76 are conveniently formed in separate molding operations. The combination assembly 71 components are conveniently comprised of molded plastic.

The joining components 77 and 78 and the joining components 79 and 80 can each be regarded as a pair of connecting panels where the member panels comprising each pair are located (with their respective connected side components 73 and 74) on opposite sides of the assembly 71, and are preferably in spaced, parallel relationship relative to each other. These components have their upper edge portions unitarily formed with adjacent lower portions of side components 73 and 74 of the aperture frame 76 and their lower edge portions unitarily formed with adjacent upper side portions of the flat monitor support assembly 72. The joining components 78 and 80 are longer in length than the joining components 77 and 79. The joining components 77, 78, 79 and 80 are so joined to the flat monitor support platform 72 as to cause the platform 72 to be inclined relative to the aperture frame 76 in the assembly 71. Since each pair of joining components 77, 78 and 79, 80 is fixed in size and position relative to the flat monitor support platform 72 and to the aperture frame 76, the position and inclination (or tilt) angle of the flat monitor support platform 72 relative to the aperture frame 76 is fixed.

The flat monitor support platform 72 can be regarded as having a flat bottom 89 which is defined by a flat back collar 98, a flat front collar 99, and flat cross collars 101A and 101B, and 102A and 102B that are all coplanar relative to one another. The central region of the bottom 89 of platform 72 is open which can be considered to enhance flat monitor connectability and flat monitor heat dissipation. The flat collars are unitarily joined together at contacting locations therebetween. The cross collars 101A and 101B, and the cross collars 102A and 102B are discontinuous, and spaced from one another, but are in opposed relationship to one another. An upstanding, unitarily formed monitor retaining railing 106 is provided about outside perimeter portions of front collar 99 and cross-collars 101B and 102B. The lower end portion of each of the joining components 77, 78,79, and 80 also acts as a railing where such components are unitarily terminally connected to portions of the collars 101A, 101B, 102A and 102B. The adjacent portions of the railing 106 and collars 101B and 102B are unitarily connected. The railing 106 and such terminally connected joining component portions 101A, 101B, 102A, and 102B cooperate to function as a flat monitor retaining means for a flat monitor 96 that rests upon the flat monitor support platform 72.

When installing a combination support assembly 71 in the preformed aperture (not shown) of a working platform (not shown), various procedures can be utilized. For example, the integrated structure comprising the flat monitor support platform 72, the aperture frame 76 opposite side components 73 and 74, and with their connected joining components 77, 78, 79 and 80 may first be utilized and associated with opposite sides of an aperture (not shown) in a working platform (not shown). Then, after positioning the support 72 below the aperture, the opposite end components 82 and 83 of the aperture frame 76 can be associated with the other opposite sides of the aperture and the four corner components 84, 85, 86 and 87 of the aperture frame 76 can be associated with the aperture and interconnected together.

Preferably, the respective opposite end portions of each of the end components 82 and 83, the side components 73 and 74, and the corner components 84, 85, 86 and 87, are provided with a tongue and groove type of configuration that permits adjacent or abutting end portions of end-adjacent components engage and lock together preferably in a snap-fit relationship. Preferably, when assembled and installed in an aperture, the completed aperture frame 76 includes features similar to those above described in relation to the aperture frame 22 of the combination assembly 21 including a continuously extending out-turned shoulder 90 (corresponding to shoulder 47), a continuously extending upper inside surface portions 91 (corresponding to upper inside surface portions 32), and a continuously extending ledge 93 (corresponding to ledge 36), whereby a window 94 is received within and supported by the frame 76.

To permit regulation of both the position of a flat monitor 96 (shown in phantom in FIG. 6) on support 72 relative to an overlying window 94, and also the inclination angle of the flat monitor 96 relative to the overlying window 94, when the monitor 96 is supported by the support 72, an adjustable cross bar 97 or the like is provided.

The cross bar 97 is adapted to extend almost across the width of the support 72. On the cross bar 97 bottom surface, adjacent each of its opposite ends, a downwardly projecting peg leg 108 is provided. In the collars 101B and 102B, adjacent each of their respective lateral sides, a series of holes 109 is provided. The holes 109 adjacent each such respective side are in spaced, parallel relationship to each other and to each such lateral side, and the spacing between the holes 109 laterally taken across the support 72 corresponds to the spacing between the peg legs 108 with the holes 109 pairs being matching and aligned. Thus, the cross bar 97 is adjustably positionable across the support platform 72 at a selected top to bottom location (relative to platform 72) by inserting the peg legs 108 into selected pairs of holes 109.

A feature of the cross bar 97 is that it has reversible opposite side faces 111 and 112 that can be exchanged with one another. Thus, one face 111 extends generally continuously and perpendicularly relative to the bottom face of cross bar 97. The opposed face 112 extends generally diagonally relative to the bottom face of cross bar 97 so that the height of this face 112 increases with increasing transverse distance from its start at the bottom face and proceeding towards the face 111. This diagonally extending face has a series of flat surfaced steps or clefts 113 defined therein. The respective flat clefts 113 permit a back edge region of a flat monitor 96 to rest thereon and be supported thereby. Thus, once a cross bar 97 position on support platform 72 is selected, if the diagonal, stair-stepped clefts on face 112 face generally towards the flat monitor 96 on support 72, then the tilt angle of the flat monitor 96 relative to frame assembly 76 and window 94 can be adjusted by selecting a particular step 113 upon which to rest the monitor 96 frontal back edge region. If, alternatively, the flat face 111 faces towards a flat monitor 96 on support 72, then only the position of the flat monitor 96 on support 72 is adjustable by the cross bar 97.

Figure 10:
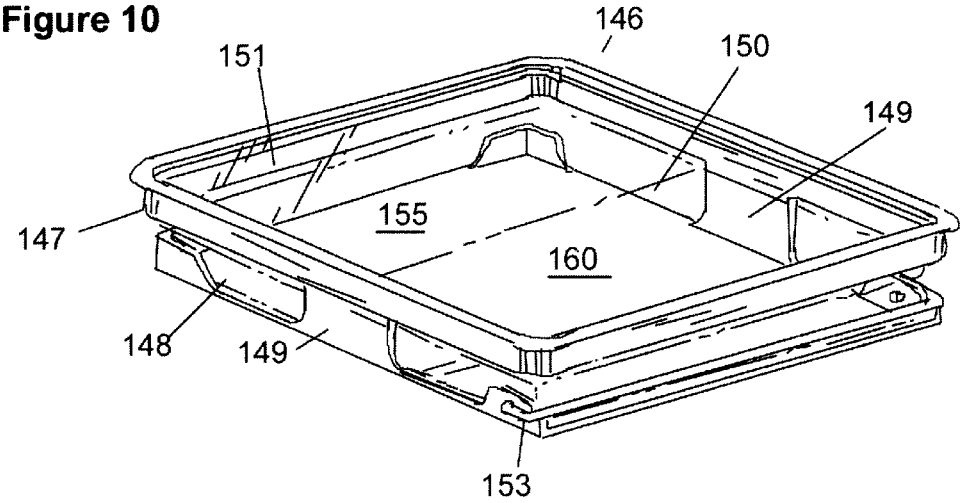
FIG. 10 is a perspective view similar to FIG. 2, but showing another alternative embodiment of the inventive combination assembly that here incorporates a unitarily formed combination assembly, the window being shown fragmentarily, and the flat monitor support platform supporting a laptop computer (the laptop computer being shown in phantom)
Figure 11:
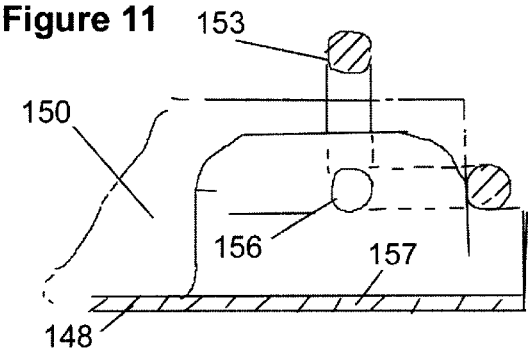
FIG. 11 is an enlarged, fragmentary, vertical sectional, detailed view taken adjacent to the front, right side portion of the combination assembly of FIG. 10 showing the retaining bar of the flat monitor support platform in its fully open position, and also showing, in partial phantom, the retaining bar in its fully closed position with the lap-top computer being shown fragmentarily and in phantom.
Figure 12:
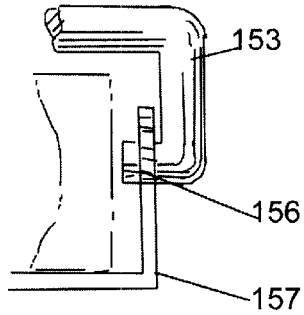
FIG. 12 is an enlarged, fragmentary, right front side elevational view of the combination assembly of FIG. 10 showing the retaining bar in its fully open position with the laptop computer being shown fragmentarily and in phantom.
Figure 13:
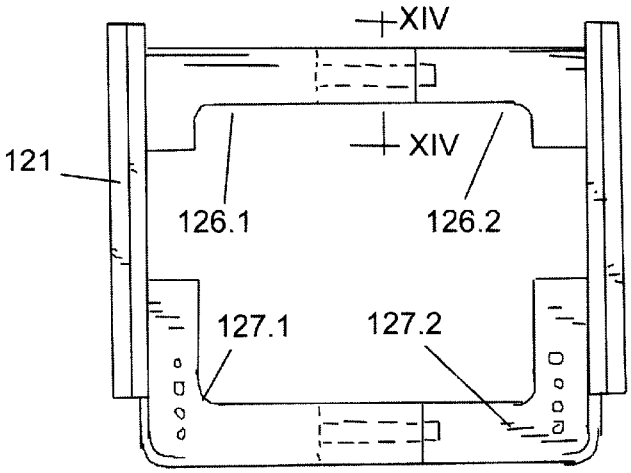
FIG. 13 is a plan view similar to FIG. 3, but showing another alternative embodiment of the inventive combination assembly wherein the aperture frame is comprised of two opposing side components, each one adapted for location along a different opposed side of an aperture in a working platform, and each aperture frame component being integral with, successively, a joining component and a flat monitor support platform component, the flat monitor support platform components being interlockingly engagable with one another.
Figure 14:
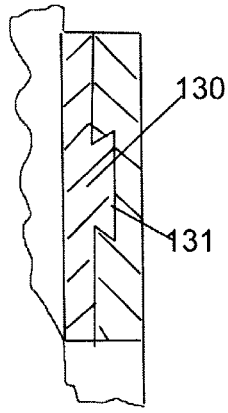
FIG. 14 is a vertical sectional view taken along the line XIV—XIV of FIG. 13.

Referring to FIGS. 10–12, there is seen another embodiment 146 of the combination assembly of the invention. Here, the aperture frame 147 and the flat monitor support platform 148 are unitarily formed together with fixed joining components 149 extending therebetween. The plane of the window 151 that is supported by the aperture frame 147 in an aperture (not shown) is substantially in spaced, parallel relationship to the flat platform of the flat monitor support platform 148.

The combination assembly 146 is suitable for usage with a flat monitor or with (as shown here in phantom) a lap-top computer 150 where the flat monitor 155 of the computer 150 remains connected with the body 160 of the laptop computer 150 during the time when the flat monitor 155 is positioned in underlying, adjacent relationship relative to a windowed aperture (not shown). To retain in a secure manner the laptop computer 150 including its flat monitor 155 in association with the support platform 148, a retaining bar 153 is provided. Opposite ends of the bar 153 are formed into a C-configuration with the terminal leg portion at each end being pivotably associated with a mating aperture 156 defined in an up-turned flange 157 provided on each opposite frontal side portion of the flat monitor support 148. Thus, the straight main or medial portion of the bar 153 is pivotable through about a 90 degree angle. When the bar 153 has its main portion upwardly but horizontally oriented with the opposite ends generally vertically oriented, as illustratively shown in FIGS. 11 and 12, the laptop computer 150 may be laterally and slidably extended onto the support platform 148 beneath the aperture frame 147 and window 149 and between the flanges 157 and the joining components 149. After the laptop computer 150 is disposed on the support platform 148, the bar 153 is manually pivoted from its open vertical position shown in FIGS. 11 and 12 to its closed horizontally extending position shown in FIG. 12 where the bar 153 is enabled to retain the laptop computer 155 in association with the support platform 148.

Referring to FIGS. 13–16, there is seen another embodiment 121 of the combination assembly of the invention. Embodiment 121 may be considered to be somewhat similar to the embodiment 71. As shown, for example, in the exploded perspective view of FIG. 15, in the combination assembly 121, the flat monitor support platform 122, the aperture frame 123 and unitarily interconnected joining components are each comprised of two component subassemblies comprising one component subassembly 122A/123A and one component subassembly 122B/123B. The flat monitor support platform is defined by collar portions that extend inwardly from the platform perimeter. The top and the bottom collars are each effectively comprised to two half portions, the top portion halves being designated for convenience as 126.1 and 126.2, and the bottom portion halves being similarly designated as 127.1 and 127.2. A unitarily formed rail 130 that is trapezoidally configured in vertical cross-section extends longitudinally on the lower surface of each half 126.1 and 127.1, and a mating longitudinally extending, trapezoidally configured in vertical cross-section channel 131 that is unitarily defined each half 126.2 and 127.2 are provided. The rail 130 is slidably end engagable with the channel 131 thereby resulting in the joining together of the component halves 126.1 and 126.2 and the component halves 127.1 and 127.2. The width of the platform 122 is thus adjustable, thereby enabling the assembly 121 to be used with apertures that vary in width.

The aperture frame 123 is comprised of opposite side components 123A and 123B that are used to support and associate the assembly 121 with opposite side portions of an aperture (not shown). The length of each side component 123A and 123B is similar to the other and this length can be shorter than the length of an aperture side. Corner components and top and bottom components of the frame 123 are not employed. The aperture frame 123 is thus enabled to be associated with apertures of various sizes.

With assembly 121. a window (not shown) can be positioned across the aperture in a working platform (not shown) and be supported by the components 123A and 123B in the manner described above with assemblies 21 and 71. If desired, after a window is associated across an aperture, one can introduce into any spacing existing between aperture perimeter portions and window edge portions a conventional filler, such as a putty, mastic, or caulk (not shown), if desired.

In the combination assembly 121, parts and components may be considered to be comparable to corresponding components in the combination support assembly 21 are similarly numbered but with the addition of prime marks thereto for convenient identification purposes.

Figure 15:
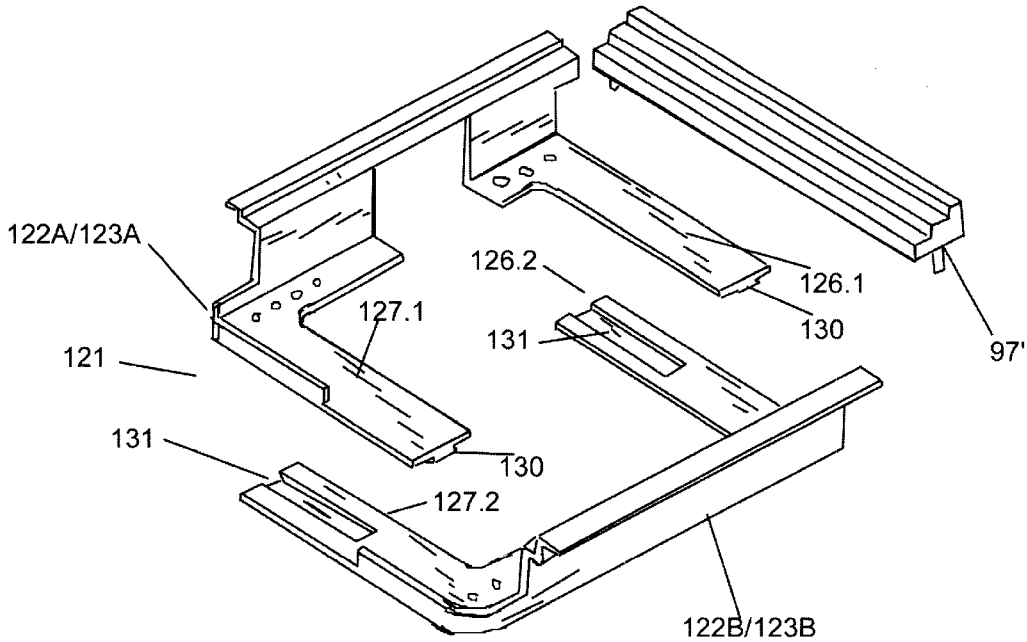
FIG. 15 is an exploded perspective view of the combination assembly of FIG. 13.
Figure 16:
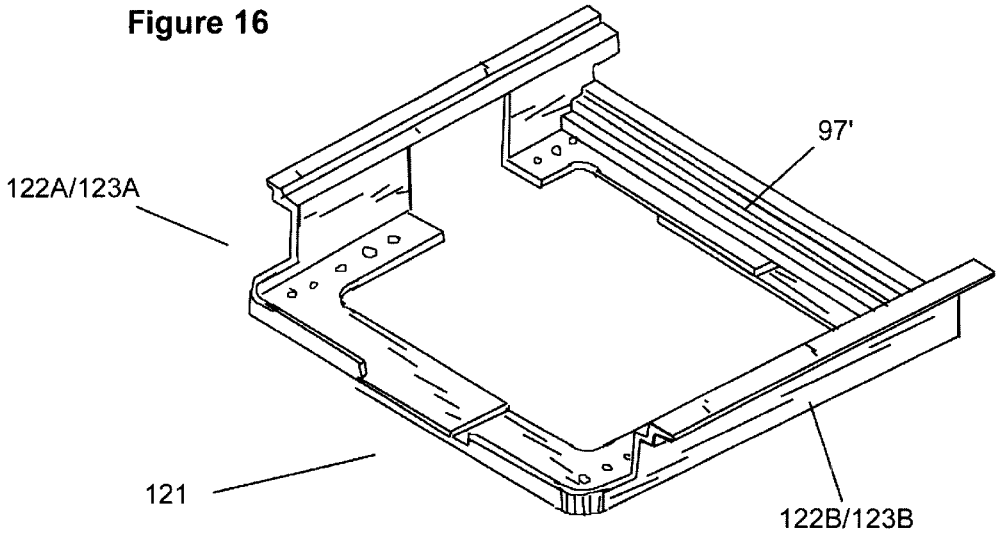
FIG. 16 is a perspective view similar to FIG. 13 but showing the engaged support platform components additionally in association with a flat monitor inclination angle adjustment block.

The combination assembly 121, as shown in FIGS. 15 and 16, preferably incorporates an adjustable cross bar 97' that is similar to that provided in the combination assembly 71.

Figure 17:
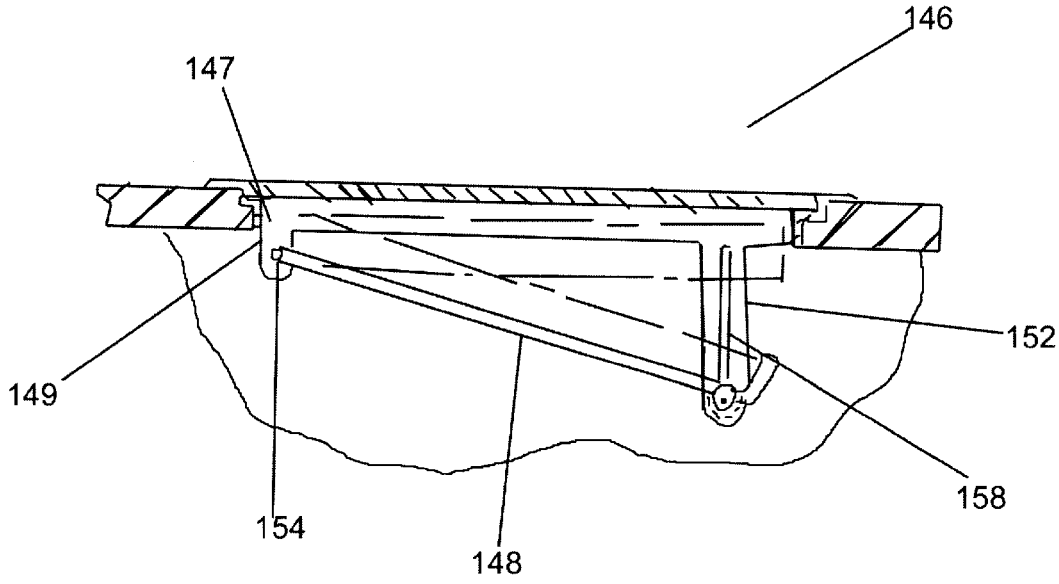
FIG. 17 is a fragmentary vertical sectional view transversely taken across the mid region of an aperture in the working platform of a work station structure such as shown in FIG. 1, but wherein the aperture is associated with another alternative embodiment of the combination assembly of the present invention, some parts thereof being broken away and some parts thereof being shown in section.

The combination assembly 146 shown in FIG. 17 illustrates an embodiment where the aperture frame 147 is unitarily formed with rearward and forward joining component pairs 149 and 152, respectively, that are configured as downwardly extending finger-like projections. Each member of the rearward pair 149 is located at a different rear corner of the aperture frame 147. Each member of the forward pair 152 is located along a different side of the aperture frame 147 adjacent to the forward side of the aperture frame 147. The rearward pair of projections 149 is shorter in length than the forward pair of projections 152. The forward pair is provided with longitudinally extending slots 158, as in assembly 21, and the rearward pair 149 is provided with apertures 154.

A flat monitor support platform 148, which is independently formed and which can be, for example, comprised of wire members welded together at adjoining abutting or cross-over locations, thereby defining a mesh-like structure, can be connected to the projection pairs 149 and 152. In-turned opposite rear corners of the platform 148 extend into the apertures 154 defined in the projections 140 so that the platform 148 is pivotable relative to the aperture frame 147. Opposite forward side portions engage adjustably the slots defined in the forward pair of projections 152 in the manner described in assembly 21 so as to fix the inclination of the platform 148 relative to the frame 147.

In assembly 146, parts and portions similar to those in assembly 21 are similarly numbered but with the addition of prime marks for identification purposes.

Various other embodiments, applications, features, alternative but equivalent structures and the like will be apparent to those skilled in the art from the present description of the invention and no undue limitations are to be drawn therefrom.

What is claimed is:

1. An assembly for supporting a flat monitor in adjacent but underlying relationship to an aperture defined through a desk-type working platform, said aperture having aperture perimeter portions that are generally defined by adjacent body portions of said working platform, said monitor generally having a flattened, rectangular configuration with opposed, flattened respective front and back side portions, and with opposed pairs of monitor perimeter edge portions that extend generally and peripherally around and between said front and back side portions, said front side portion incorporating a monitor viewing screen, and said back side portion and said perimeter edge portions comprising a flat monitor case moiety, said assembly for supporting comprising in combination:

an aperture frame for adjacently extending about said aperture perimeter portions;

a flat monitor support platform upon which at least parts of said monitor back side portion can rest when said platform is in a generally horizontal orientation, and joining components extending between and interconnecting portions of said aperture frame with portions of said flat monitor support platform so that said flat monitor support platform is generally in adjacent relationship relative to said aperture frame;

the relationship between said aperture frame, said flat monitor support platform, and said joining components being such that said flat monitor is supportable by said flat monitor support platform with said flat monitor support platform being generally suspended from said aperture frame when said aperture frame so extends about said aperture perimeter portions, and said monitor viewing screen when said flat monitor is so supported is viewable through said aperture.

2. The assembly of claim 1 wherein said aperture frame, relative to said working platform, is generally thickened in depth and generally transversely flattened, and, relative to said aperture, has outside facial portions that are in adjacent relationship to said adjacent body portions of said working platform.

3. The assembly of claim 2 wherein said aperture frame, relative to said aperture, has inside facial portions that are configured to receive slidably thereover edge portions of a window pane that is received within said aperture.

4. The assembly of claim 2 wherein said aperture, said aperture frame, and said flat monitor support assembly are each generally rectangularly configured, said aperture frame, relative to said outside and inside facial portions, has outer and generally opposed inner border portions, and said flat monitor support platform aperture frame is generally adjacent to and vertically generally aligned with said inner border portions.

5. The assembly of claim 4 wherein said outer border portions include an out turned flange extending about at least a portion thereof whereby said out turned flange is adapted to engage portions of said working platform that are adjacent to said aperture.

6. The assembly of claim 1 which further includes fastening means for fastening said aperture frame to said working platform.

7. The assembly of claim 1 wherein said aperture frame is unitarily formed and extends continuously around said aperture perimeter.

8. The assembly of claim 1 wherein said aperture frame is comprised of a plurality of preformed components which each have outside and generally opposed inside facial portions, and outer and generally opposed inner border portions, said flat monitor support platform is generally adjacent to said inner border portions, and each respective opposite end of each said preformed components associates with an opposite end of the next adjacent said preformed component comprising said aperture frame.

9. The assembly of claim 8 wherein said plurality of preformed components is comprised of a pair of opposite side members, a pair of opposite end members, and four corner members, and wherein each of said corner members connects in end opposed relationship at one opposite end thereof with an end of a different one of said side members and at the other opposite end thereof with an end of a different one of said end members.

10. The assembly of claim 1 wherein said joining components include a plurality of arm-like members each of which extends between and interconnects a portion of said aperture frame with a portion of said flat monitor support platform, said arm-like members being parametrically spaced from one another along each of said aperture frame and said flat monitor support platform, respectively.

11. The assembly of claim 10 wherein said joining components comprise at least two arm-like members.

12. The assembly of claim 10 wherein said joining components comprise (a) two arm-like members each of which is unitarily joined to a different respective side portion of said aperture frame and each of which includes means for adjustably connecting a selected length portion thereof to a different respective side portion, said flat monitor support platform and (b) one hinge structure which is joined to a pair of respective adjacent end portions of said aperture frame and said flat monitor support platform and about which said flat monitor support platform is articulatable relative to said aperture frame.

13. The assembly of claim 10 wherein said aperture frame has outer and generally opposed inner border portions;

said flat monitor support platform has platform perimeter regions that are generally adjacent to said inner border portions;

said arm-like members generally extend between areas of said frame inner border portions and areas of said platform peripheral portions; and said arm-like members each include connecting means connecting each said arm-like member with adjacent said areas of said frame inner border portions and with adjacent said areas of said platform peripheral portions.

14. The assembly of claim 13 wherein, at respective upper terminal portions of each of said arm-like members, said connecting means fixedly and integrally interconnects each said arm-like member with said adjacent areas of said frame inner border portions.

15. The assembly of claim 14 wherein, at respective lower terminal portions of each of said arm-like members, said connecting means fixedly and integrally interconnects each said arm-like member with said adjacent areas of said platform perimeter regions.

16. The assembly of claim 13 wherein, along respective medial portions of each of said arm-like members, location adjustable connecting means interconnects each said arm-like member with said adjacent areas of said platform perimeter regions.

17. The assembly of claim 16 wherein said joining components additionally include hinge means, and said hinge means interconnects a region of said frame inner border portion with a region of said platform perimeter whereby said flat monitor support platform is articulatable relative to said aperture framed and whereby said location adjustable joining means permit said flat monitor support platform to be inclined at a desired angle relative to said aperture frame.

18. The assembly of claim 17 wherein said location adjustable joining means comprises (a) a longitudinally extending channel defined in at least a medial region of each said arm-like member, and (b) a headed screw member whose shank extends through said channel and threadably engages an adjacent region of said flat monitor support platform whereby the position of said screw is adapted to fix the position of said flat monitor support platform relative to said arm-like member.

19. The assembly of claim 1 wherein said joining components cooperate to maintain said flat monitor support platform in a fixed spatial position relative to said aperture frame.

20. The assembly of claim 19 wherein said joining components maintain said flat monitor support platform generally in spaced, parallel relationship relative to said aperture frame.

21. The assembly of claim 19 wherein said joining components maintain said flat monitor support platform generally in an inclined relationship relative to said aperture frame.

22. The assembly of claim 1 wherein said joining components further include orientation adjustment means for positioning said flat monitor support platform in selected orientation positions relative to said aperture frame.

23. The assembly of claim 22 wherein said adjustment means is cooperatively associated with said joining components.

24. The assembly of claim 22 wherein said adjustment means is integrally formed with said joining components and with at least one of said aperture frame and said flat monitor support platform.

25. The assembly of claim 22 wherein said adjustment means is cooperatively associated with both said joining components and with said flat monitor support platform.

26. The assembly of claim 22 wherein said adjustment means is cooperatively associated with said joining components, said flat monitor support platform, and said aperture frame.

27. The assembly of claim 26 wherein said adjustment means comprises a coacting combination of means for changing the inclination angle of said flat monitor support platform relative to said aperture frame and means for adjustably fixing said inclination angle at a desired value.

28. The assembly of claim 27 wherein said adjustment means comprises hinge means that interconnects an end portion of said flat monitor support platform with an end portion of said aperture frame whereby said flat monitor support platform is articulatable relative to said aperture frame, and at least one length-adjustable arm member that interconnects said aperture frame with said flat monitor support platform whereby the spacing between the opposite end of said flat monitor support means and the opposite end of said aperture frame is adjustable.

29. The assembly of claim 1 wherein said flat monitor support platform includes at least one upstanding flange member with portions that are adapted to contact adjacent perimeter edge portions of a flat monitor having back side portions that rest upon said flat monitor support platform, thereby to retain said flat monitor in a desired resting contact with said flat monitor support platform.

30. The assembly of claim 29 wherein at least one said upstanding flange member is located along a perimeter edge portion of said flat monitor support platform.

31. The assembly of claim 30 wherein said one upstanding flange member further includes pivotable adjustment means whereby, relative to said flat monitor support platform, said upstanding flange member can be either in a selected upright orientation or in a selected supine orientation so that, when said upstanding flange member is in said supine orientation, a flat monitor is extendable thereover onto said flat monitor support platform, and, when said upstanding flange member is in said upright configuration, a flat monitor is retainable in resting residence upon said flat monitor support platform.

32. The assembly of claim 29 wherein one said upstanding flange member includes means for adjusting the angle of inclination of a flat monitor that resides upon said flat monitor support platform.

33. The assembly of claim 29 wherein one said upstanding flange member is provided which is associated with adjustment means for adjustably positioning said upstanding flange member relative to said flat monitor support platform so that said upstanding flange member can abut against predetermined perimeter edge portions of a flat monitor that rests upon said flat monitor support platform whereby the position of said flat monitor upon said flat monitor support platform is adjustable when said flat monitor support platform is inclined relative to said aperture frame.

34. The assembly of claim 1 wherein said flat monitor support platform extends discontinuously and includes open areas so that a flat monitor that rests upon said flat monitor support platform has only portions of said back face thereof in contact therewith.

35. The assembly of claim 34 wherein said flat monitor support platform includes a flat surface portion for supporting portions of said flat monitor back face resting thereupon, and said flat surface portion extends in at least one perimeter-adjacent region of said flat monitor support platform.

36. The assembly of claim 35 wherein said flat surface portion extends continuously about a perimeter-adjacent region of said flat monitor support platform.

* * * * *